US010658738B2

(12) United States Patent
Maloney et al.

(10) Patent No.: US 10,658,738 B2
(45) Date of Patent: May 19, 2020

(54) FRAGMENTED APERTURE ANTENNAS

(71) Applicants: James Geoffrey Maloney, Marietta, GA (US); John Weber Schultz, Alpharetta, GA (US)

(72) Inventors: James Geoffrey Maloney, Marietta, GA (US); John Weber Schultz, Alpharetta, GA (US)

( * ) Notice: Subject to any disclaimer, the term of this patent is extended or adjusted under 35 U.S.C. 154(b) by 0 days.

(21) Appl. No.: 15/233,471

(22) Filed: Aug. 10, 2016

(65) Prior Publication Data

US 2017/0047650 A1 Feb. 16, 2017

Related U.S. Application Data

(60) Provisional application No. 62/203,316, filed on Aug. 10, 2015.

(51) Int. Cl.

| | |
|---|---|
| ***H01Q 1/38*** | (2006.01) |
| ***H01Q 9/04*** | (2006.01) |
| *H01Q 15/00* | (2006.01) |

(52) U.S. Cl.

CPC ..... *H01Q 1/38* (2013.01); *H01Q 9/0407* (2013.01); *H01Q 9/0442* (2013.01); *H01Q 15/002* (2013.01)

(58) Field of Classification Search

CPC .. H01Q 1/36; H01Q 1/38; H01Q 9/04; H01Q 9/0407; H01Q 9/0442; H01Q 15/0093; H01Q 15/002; H01Q 15/0066

See application file for complete search history.

(56) References Cited

U.S. PATENT DOCUMENTS 7,015,868 B2 * 3/2006 Puente Baliarde ..... H01Q 1/36 343/800

2016/0372816 A1 * 12/2016 Liu ..... H01Q 1/2208

* cited by examiner

*Primary Examiner* — Daniel Munoz

*Assistant Examiner* — Patrick R Holecek

(74) *Attorney, Agent, or Firm* — Thomas Horstemeyer, LLP

(57) ABSTRACT

Various examples are provided for fragmented aperture antennas. In one example, a fragmented aperture antenna includes a two-dimensional lattice of conducting elements, where positioning of the conducting elements in adjacent rows are offset based upon a fixed skew angle. In another example, a fragmented aperture antenna includes a two-dimensional lattice comprising a combination of first and second geometric conducting elements, where a second geometric conducting element provides a connection between adjacent sides of diagonally adjacent first geometric conducting elements. In another example, a fragmented aperture antenna includes a two-dimensional lattice of conducting elements having a single common non-rectangular shape, where the conducting elements interleave in a digitated fashion. Diagonally adjacent conducting elements overlap along a portion of adjacent edges of the diagonally adjacent conducting elements.

19 Claims, 9 Drawing Sheets

| Fitness Score Comparison | Tradiational Mutation Algorithm | New Mutation Algorithm |
|---|---|---|
| Best of 3 Trials | -2.238 | -1.684 |
| Middle | -3.208 | -2.461 |
| Worst | -3.727 | -2.850 |

FRAGMENTED APERTURE ANTENNAS

CROSS REFERENCE TO RELATED APPLICATIONS

This application claims priority to, and the benefit of, U.S. provisional application entitled "Fragmented Aperture Antennas" having Ser. No. 62/203,316, filed Aug. 10, 2015, which is hereby incorporated by reference in its entirety.

BACKGROUND

Originally, fragmented aperture antennas were envisioned as a planar surface with a grid of rectangular regions or pixels that are either conducting or non-conducting. A genetic algorithm (GA) and a computational electromagnetic model were used to determine which pixels should be conducting and which should be non-conducting to form an antenna surface suitable for a given use.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
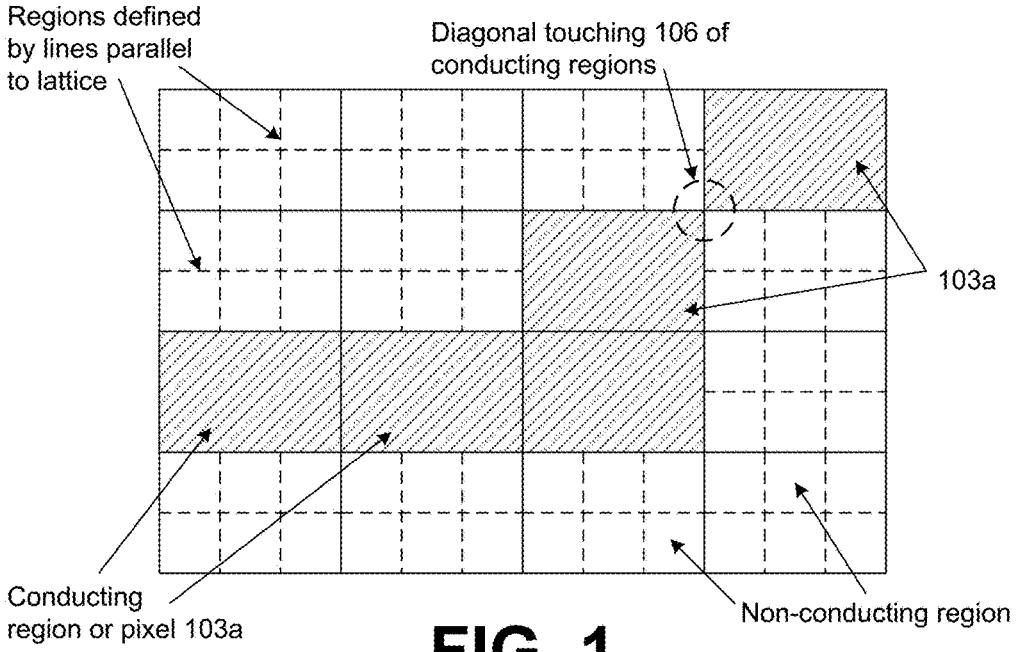
FIGS. 1 through 4 illustrate examples fragmented aperture antennas in accordance with various embodiments of the present disclosure.

Disclosed herein are various embodiments related to fragmented aperture antennas. Reference will now be made in detail to the description of the embodiments as illustrated in the drawings, wherein like reference numbers indicate like parts throughout the several views.

Figure 2:
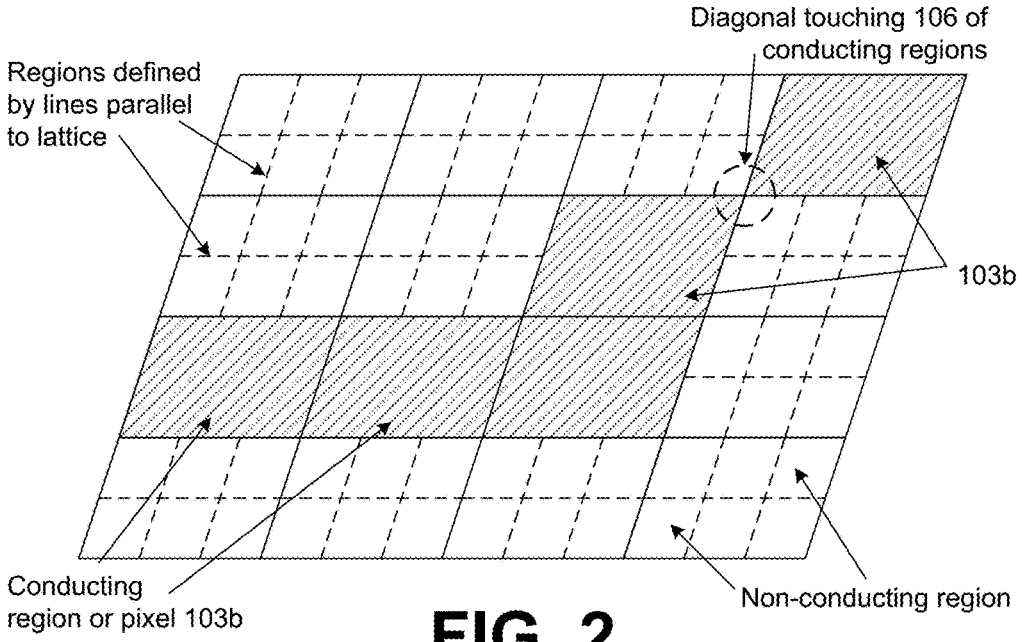

The physical shape and size of highly pixelated apertures can been optimized using genetic algorithms (GA) and full-wave computational electromagnetic simulation tools (i.e. FDTD) to best meet desired antenna performance specifications (e.g., gain, bandwidth, polarization, pattern, etc.). FIG. 1 shows an example of a fragmented aperture antenna including a grid of rectangular pixels 103*a*. Visual inspection of the design shows that the metallic pixels 103 form many connected and disconnected fragments. Hence, the term fragmented aperture antenna has been coined for this class of antennas. The approach illustrated in FIG. 1 has been successfully used to design novel antennas. This concept can be generalized to conducting or non-conducting parallelogram pixels 103*b* as shown in FIG. 2.

However, the original fragmented design approach suffers from two major deficiencies. First, the placement of pixels 103 on a generalized, rectilinear grid leads to the problem of diagonal touching as illustrated in the top right of FIGS. 1 and 2. Pixels 103 that touch diagonally (i.e., diagonal touching 106) lead to poor measurement/model agreement. Second, the convergence in the GA stage of the design process is poor for high pixel count (>>100) apertures.

Figure 3:
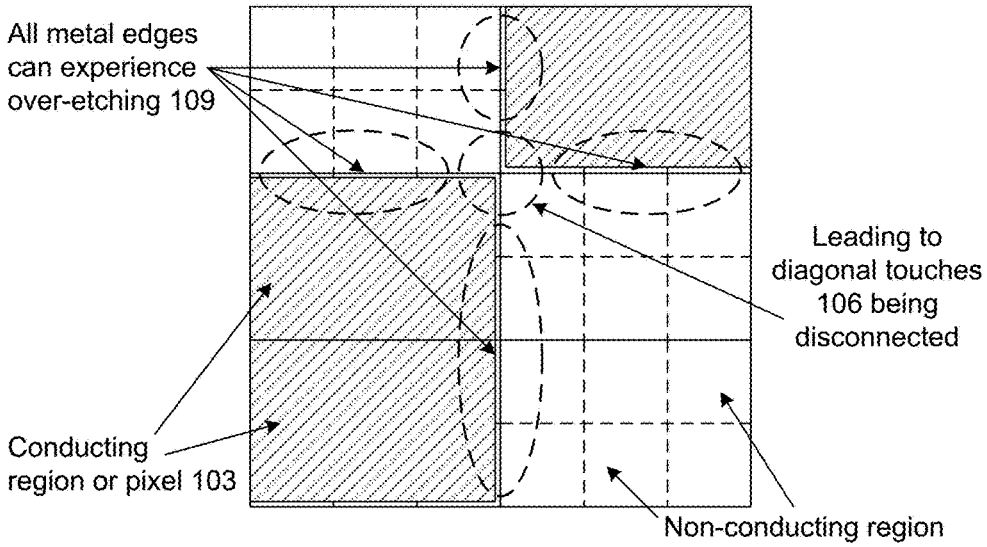

Diagonal touching 106 is not a problem during the design phase because in the numerical models the diagonally touching 106 of pixels 103 in the antenna are always touching. However, when fabricated using approaches such as printed circuit board etching, the pixels 103 are often disconnected because of over-etching. FIG. 3 illustrates an example of over-etching 109 that can lead to diagonal touches 106 between conducting regions 103 being disconnected. Disconnecting metal pixels 103 that should be connected within an antenna causes problems with the antenna impedance and gain characteristics.

Figure 4:
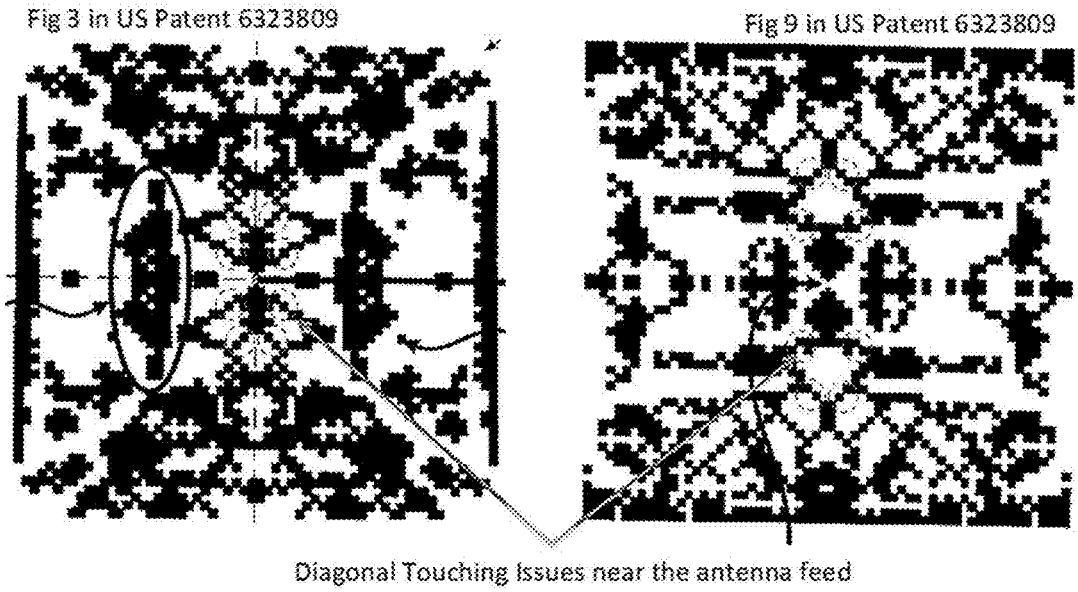

In fact, nearly every fragmented aperture antenna design presented in U.S. Pat. No. 6,323,809 suffers from this issue of diagonal touching. FIG. 4 illustrates examples of diagonal touching 106 in two designs from U.S. Pat. No. 6,323,809. It has been noted that if the pixels 103 have edges parallel to the lattice forming vectors (as in the approaches of FIGS. 1 and 2), then the issue of "diagonal touching" 106 will persist. Various approaches will be presented that have been successfully used to mitigate these diagonal touching issues.

Mitigation of Diagonal Touching

Figure 5A:
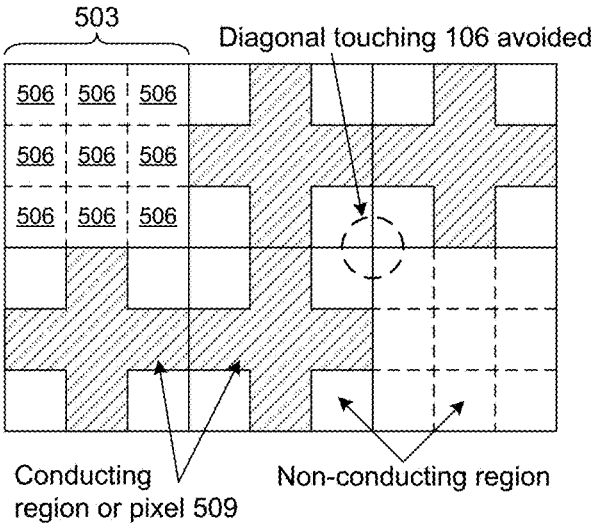
FIGS. 5A through 5D illustrate examples of fragmented aperture antenna designs addressing diagonal touching in accordance with various embodiments of the present disclosure.

One approach utilizes a super-cell approach as illustrated in FIG. 5A. A super-cell 503 is a collection of smaller areas such as, e.g., a 3 by 3 lattice of the smaller pixels or sub elements 506 as shown in FIGS. 5A-5D. To avoid diagonal touching 106, define the conducting region or pixel 509 as covering the 5 sub-elements 506 that defined a plus sign within the super-cell 503. Hence, the absence of conducting material in the corners of the super-cell 503 prevents any potential for diagonal touching 106. This successfully allows antennas to be designed and fabricated with a high probability of good correlation between measured and modeled characteristics of the antenna. In this approach, the electrical currents are constrained to flow in only grid conforming directions, which may limit optimization of the antenna designs.

Figure 5B:
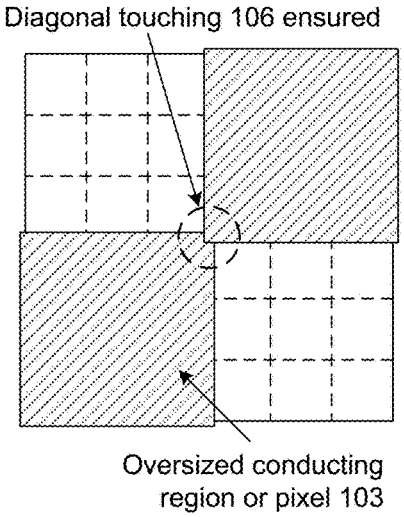

Another approach includes fabrication of every pixel 103 with an area that is roughly 10% larger than designed, as illustrated in FIG. 5B. Oversizing the pixels 103 ensures diagonal touching 106 by overlapping with diagonally adjacent pixels 103. This approach was found to lead to a high percentage of good fabricated antennas. However, this approach leads to the antennas having approximately 10-20% more conductor area than originally designed, which can lead to less than desired antenna characteristics in the fabricated antennas.

It is worth noting that fabricating the conducting pixels 103 to be 10% smaller, would guarantee the pixels 103 would never diagonally touch 106, but this would lead to antennas that never have conducting areas larger than one pixel 103, which would almost never be any good. Also, this would be contrary to the numerical models used in design where the conducting elements 103 always touch when diagonally adjacent.

Figure 5C:
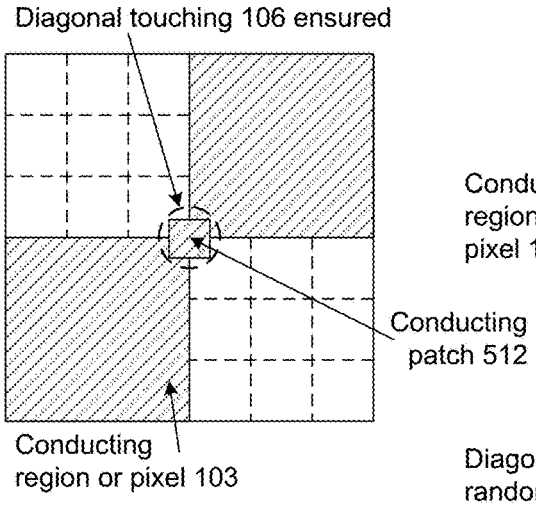
Figure 5D:
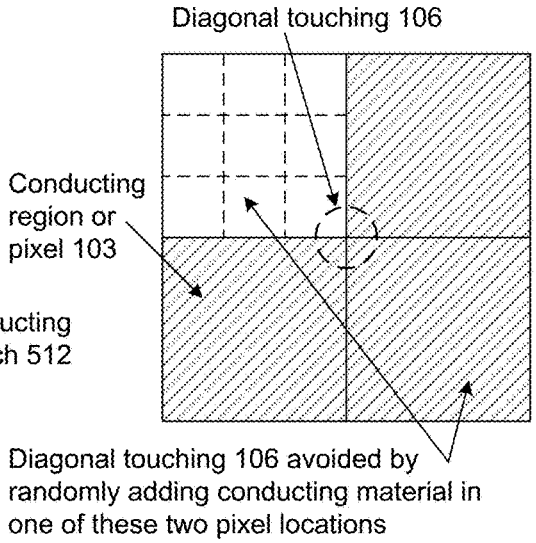

Other implementations include a variant of the slightly larger pixel strategy of FIG. 5B, where a small patch 512 of conducting material or metal is placed at the diagonal touching location as shown in FIG. 5C. The small patch 512 can be a square as illustrated in FIG. 5C or other appropriate geometrical shape. Another implementation is illustrated in FIG. 5D, where one of the two open pixel locations adjacent to the diagonal touching 106 is coated with conductive material. A random coin flipping process can be used to decide which of the two non-conducting pixel locations to make conducting to fix the diagonal touch 106 as shown in FIG. 5D.

Various approaches for avoiding diagonal touching 106 by breaking the dependence of element edges and lattice directions implicit in FIGS. 1 and 2 will now be discussed. Three approaches for breaking this dependence are presented which can lead to improved fragmented aperture antennas.

Figure 6:
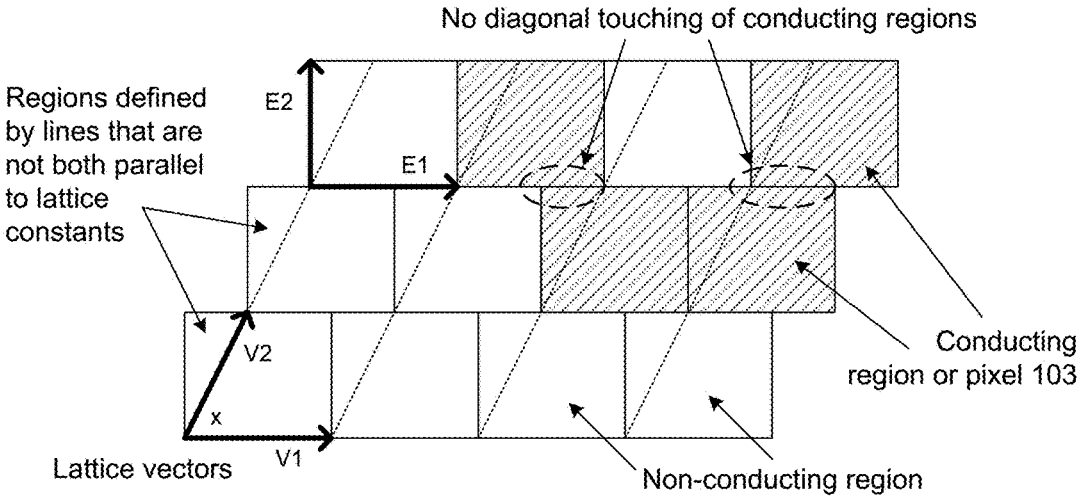
FIGS. 6 through 8 illustrate examples fragmented aperture antenna designs that avoid diagonal touching in accordance with various embodiments of the present disclosure.
Figures 10, 11:
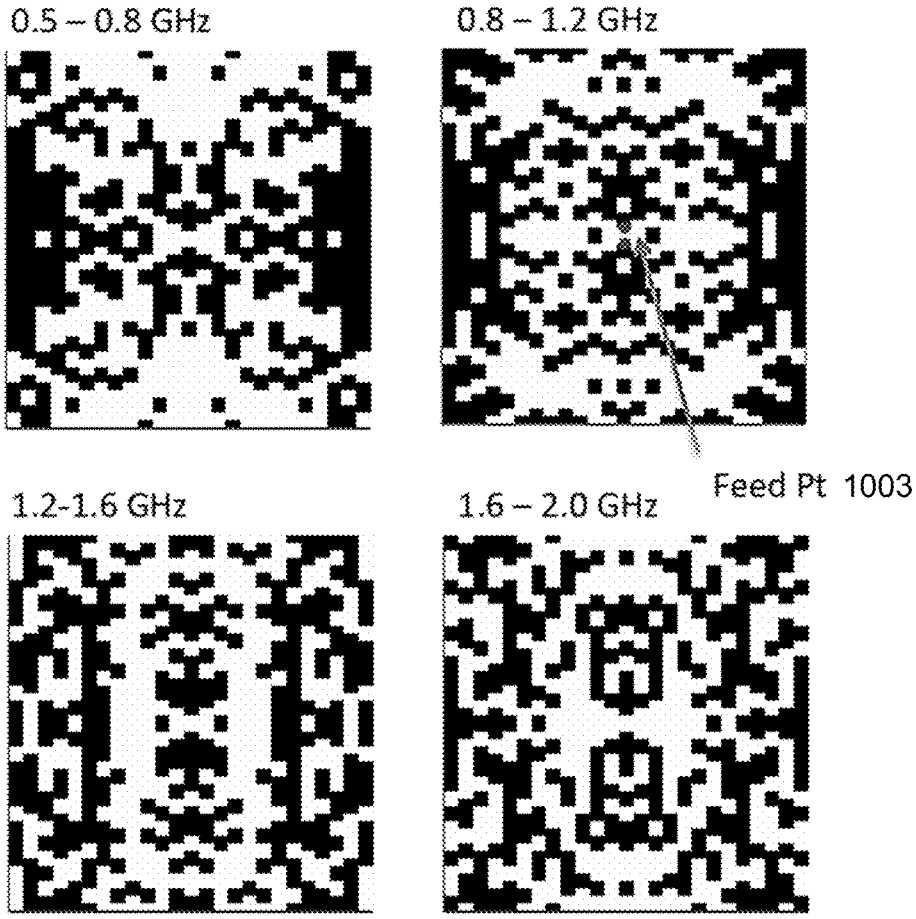
FIG. 10 is a table illustrating a comparison of the traditional mutation algorithm and the adjacency-based mutation algorithm in accordance with various embodiments of the present disclosure.
FIG. 11 illustrates examples of representative aperture designs based upon the arrangements of FIG. 6 in accordance with various embodiments of the present disclosure.

First Approach. In a first approach to improve the fragmented apertures, the location of individual conducting/non-conducting elements can be defined using a second set of directions (or lattice vectors) that are not both parallel with the lattice constants or edges of the conducting regions or pixels 103 as illustrated in FIG. 6. In the example of FIG. 6, the antenna comprises a lattice of square or rectangular conducting elements 103 where the lattice includes an X degree skewed lattice such that the adjacent conducting regions 103 are offset from each other based on the skew. Edge vectors E1 and E2 define the lattice constants with at least one of the lattice vectors V1 and/or V2 not being in parallel with E1 or E2. In FIG. 6, skewing the lattice vector V2 has removed the diagonal touching possibility. The skew angle X will be less than 90 degrees, and can be in a range from 75 degrees to 45 degrees, a range from 60 degrees to 45 degrees, or in a range from 70 degrees to 50 degrees. In the examples of FIG. 11, the skew angle is about 63 degrees. In some implementations, both lattice vectors V1 and V2 may be skewed.

Figure 7:
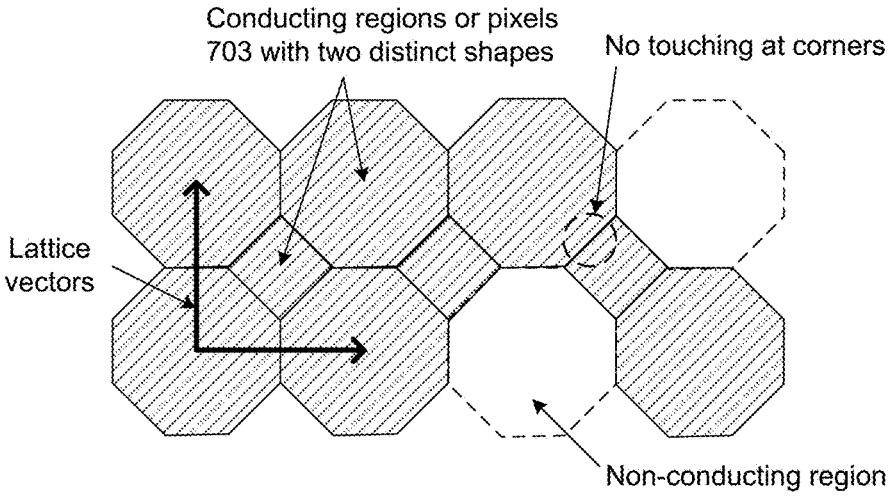

Second Approach. In a second approach to improve the fragmented apertures, the shapes of fundamental conducting regions and non-conducting regions can alternate such that the conducting elements 703 diagonally touch in a definite manner as illustrated in FIG. 7. In the example of FIG. 7, the shapes of the two regions comprise an octagon and a diamond. Other combinations of geometric shapes can be chosen such that the pair of shapes tessellate the plane.

Figure 8:
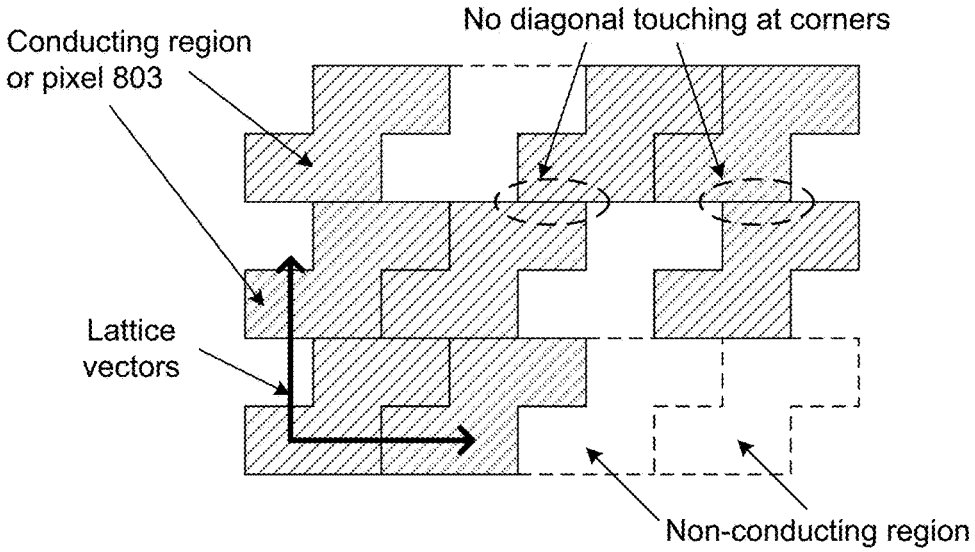

Third Approach. In a third approach to improve the fragmented apertures, the shape of the fundamental conducting regions and non-conducting regions is chosen such that the single shape tessellates the plane and does not touch diagonally. FIG. 8 shows one example of such a conducting element or pixel 803, but many other shapes can also be utilized. The shape of the conducting element 803 in FIG. 8 is a skewed-Z that allows the regions to be interleaved in an interdigitated fashion to cover the plane.

Mutation Algorithm to Improve Convergence Rate of Fragmented Apertures

Traditionally, fragmented aperture antennas are designed using evolutionary algorithms like the genetic algorithm of U.S. Pat. No. 6,323,809, which is hereby incorporated by reference in its entirety. One important step in the genetic algorithm is called mutation. In a standard genetic algorithm, mutation is a random process where a small number of genes are changed each generation to help avoid convergence to a suboptimal solution. For a fragmented antenna, mutation makes a few pixels randomly conducting or not in the next population of antennas. Many of these mutations will create only an isolated metal pixel or small hole in metal that will have a very negligible effect on the antenna performance.

A modified mutation algorithm tailored for fragmented aperture antennas can be introduced to help speed up the convergence of the design process when the number of elements/pixels is high. The goal of the new or modified mutation process is to bias mutation to either increase the size of conducting fragments in empty (or non-conducting) regions or increase the size of holes (or non-conducting areas) in large metal (or conducting) regions. This new mutation process uses an adjacency matrix that describes which conductive elements/pixels are touching each other. The adjacency matrix provides a two-dimensional metric describing which pixels are touching which other adjacent pixels. The adjacency matrix can range from 4 to 8 depending on the lattice type and the definition of touching.

Figure 9:
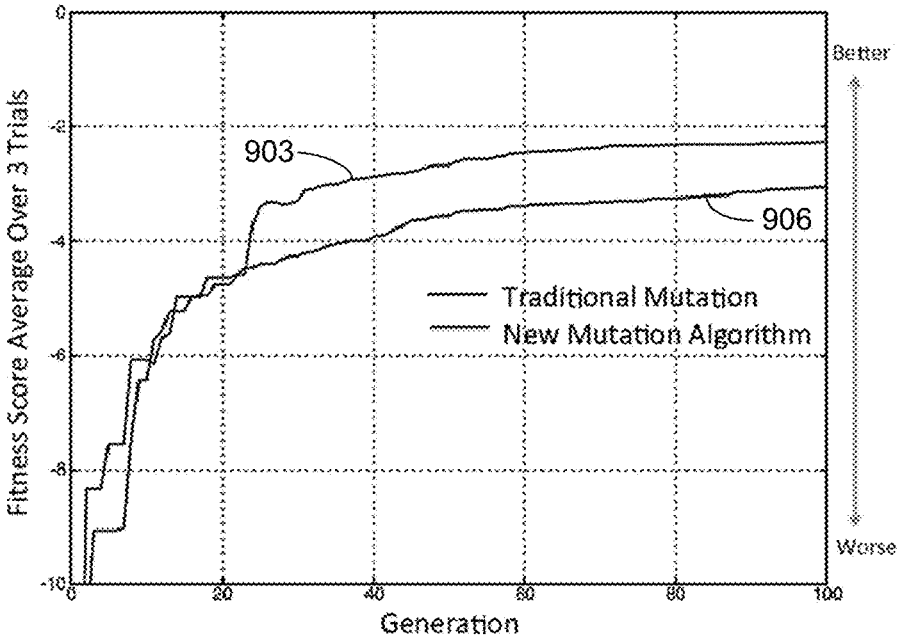
FIG. 9 illustrates an example of fitness score for a traditional mutation algorithm and an adjacency-based mutation algorithm as a function of generation count in accordance with various embodiments of the present disclosure.

To demonstrate the efficacy of this adjacency-based mutation strategy, three consecutive design trials were conducted with the traditional mutation algorithm and with the new mutation algorithm. FIG. 9 illustrates the convergence of the fitness as a function of generation count. The fitness of any generation is the fitness of the best individual. The y-axis shows the average best individual across three trials. The adjacency-based mutation algorithm (curve 903) converges to a better score in less generations than the traditional mutation algorithm (curve 906).

As shown in the table in FIG. 10, the three trials with the adjacency-based mutation algorithm were each better than the corresponding trial with the traditional mutation algorithm. The values in the table in FIG. 10 also illustrate that when using an evolutionary algorithm (e.g., the genetic algorithm) to design a fragmented aperture antenna or any electromagnetic device, more than one design trial should be executed because as illustrated in this table, the subsequent designs can be more than a dB better than the first design.

Examples of Fragmented Aperture Designs

First Approach. The approach illustrated in FIG. 6 was used to design a series of fragmented aperture antennas that spanned from 500 MHz to 2.0 GHz. The lattice skew angle, X, was chosen to be $\tan^{-1}(2)$~63.435 degrees to give the desired left/right physical symmetry. The square pixels 103 were 10.8 mm on a side and the total aperture area was 25.4 cm×25.4 cm. Four representative aperture designs are shown in FIG. 11. Each of the four sample antenna designs are excited at the terminal pair (feed point 1003) in the center with a 100 ohm transmission line. As the aperture designs in FIG. 11 show, none of the physical shapes of the designed antennas suffer from diagonal touching issues.

The aperture designs (the placement of conducting and non-conducting regions) were performed using a genetic algorithm with adjacency-based mutation. For these designs, the 25.4 cm×25.4 cm area have 663 individual pixels. Enforcing left/right and top/down symmetry, there are 169 degrees of freedom. Hence assigning a single bit to represent the state of each area (1=conducting, 0=non-conducting) yields a 169 bit genetic code. Using a genetic population size of 32 antennas, 100 genetic algorithm generations was typically required to realize one of these sample designs. The genetic algorithm used a finite-difference time-domain (FDTD) numerical model of each antenna to compute return loss and radiation properties for the evolving population of antennas. The genetic algorithm fitness function rewarded good match (return loss better than 15 dB), and as large as possible, broadside realized gain.

Figure 12:
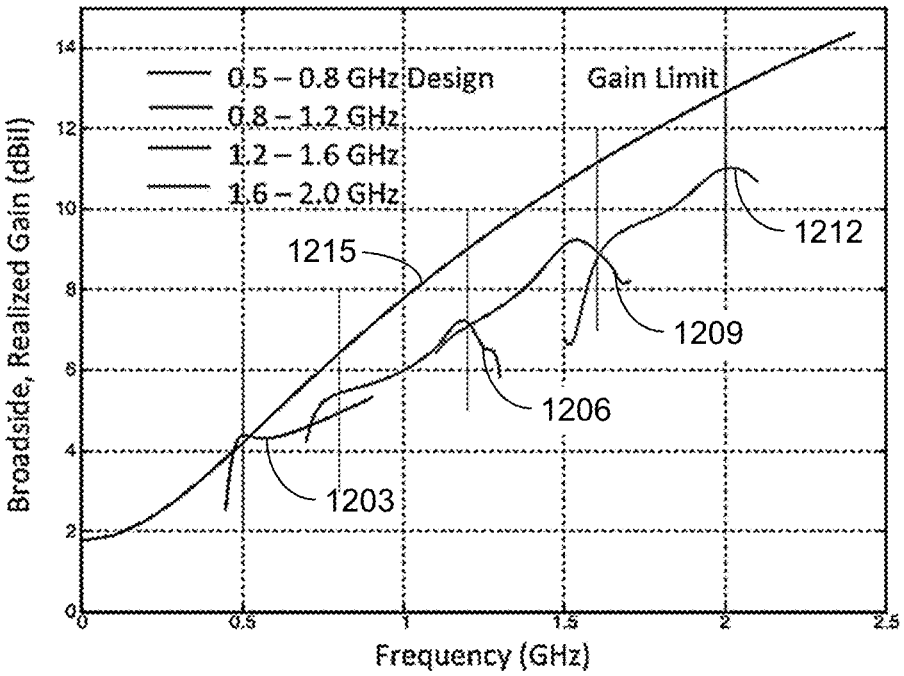
FIGS. 12 and 13 illustrate test results of the representative aperture designs of FIG. 11 in accordance with various embodiments of the present disclosure.
Figure 13:
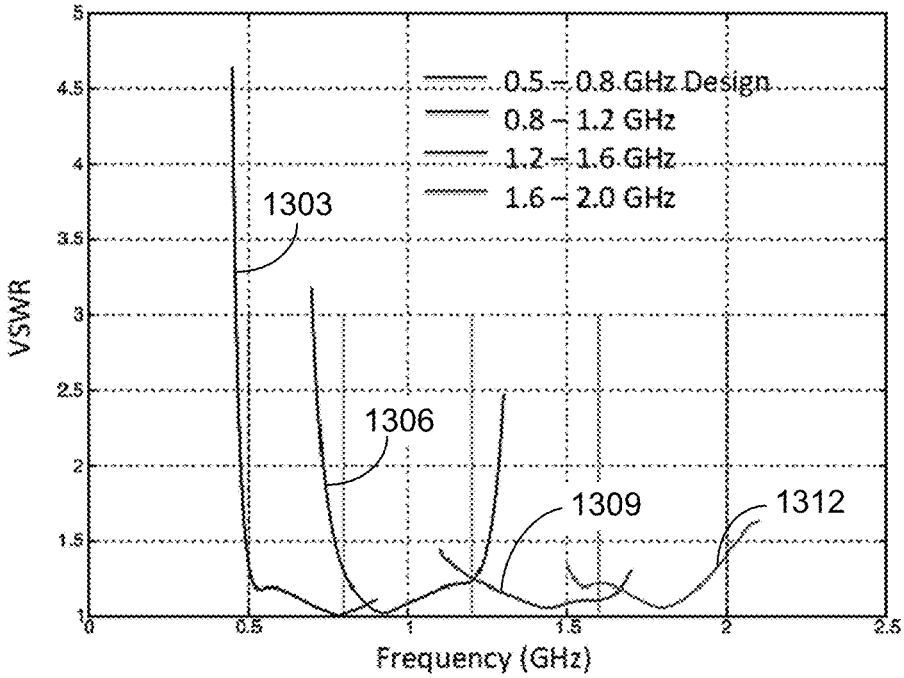

FIG. 12 shows the broadside realized gain of each antenna design, while FIG. 13 shows the return loss of each antenna. Curve 1203 shows the 0.5-0.8 GHz design, curve 1206 shows the 0.8-12 GHz design, curve 1209 shows the 1.2-1.6 GHz design, and curve 1212 shows the 1.6-2.0 GHz design. The gains are compared with an aperture gain limit (curve 1215). Since these apertures have no ground plane, the aperture gain limit for high frequencies is $2\pi(\text{Area})/\lambda^2$. As shown in FIG. 13, the VSWR of the four designs of FIG. 11 are below 1.5 across the respective design bands which is consistent with a return loss of better than 15 dB. Curve 1303 shows the 0.5-0.8 GHz design, curve 1306 shows the 0.8-12 GHz design, curve 1309 shows the 1.2-1.6 GHz design, and curve 1312 shows the 1.6-2.0 GHz design.

Figure 14:
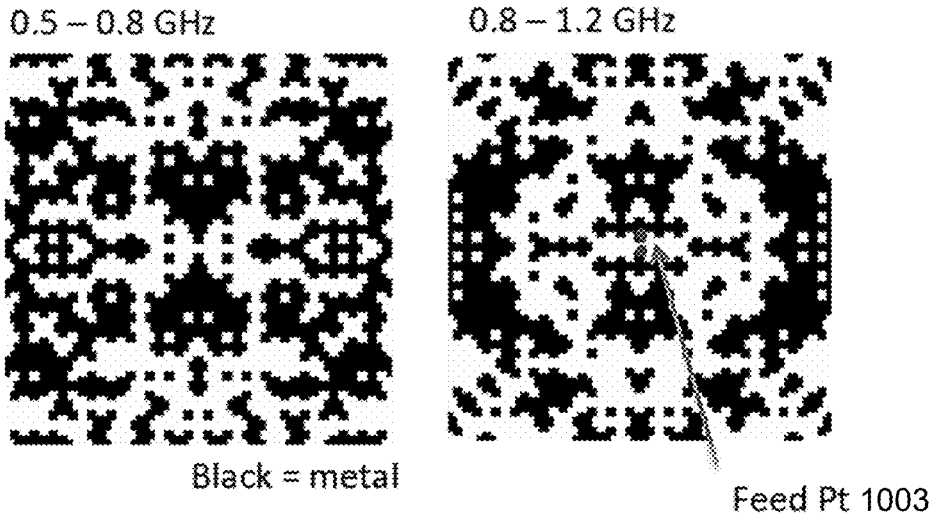
FIG. 14 illustrates examples of representative aperture designs based upon the arrangements of FIG. 7 in accordance with various embodiments of the present disclosure.

Second Approach. The second approach illustrated in FIG. 7 is also useful for designing antennas. The second approach also supports left/right and top/down symmetry when appropriate. The aperture area was again 25.4 cm×25.4 cm and was excited in the center with a 100 ohm feed. The aperture has 841 shaped pixels. When left/right and top/down symmetry was enforced, the number of degrees of freedom dropped to 221. FIG. 14 shows examples of two designed apertures for the 0.5-0.8 GHz and the 0.8-1.2 GHz bands. The sample antenna designs are excited at the terminal pair (feed point 1003) in the center with a 100 ohm transmission line.

Figure 15:
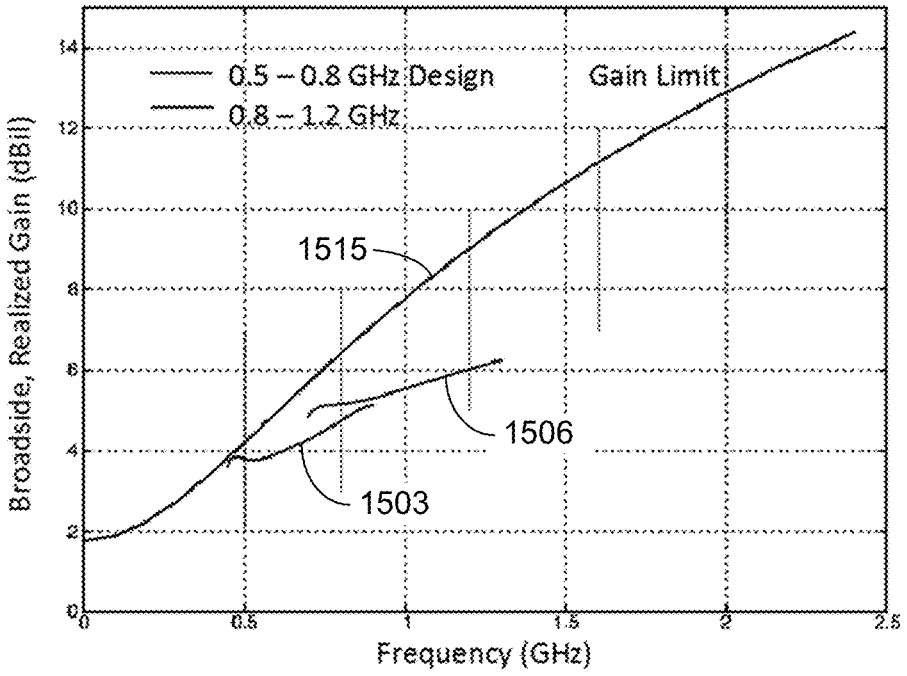
FIGS. 15 and 16 illustrate test results of the representative aperture designs of FIG. 14 in accordance with various embodiments of the present disclosure.
Figure 16:
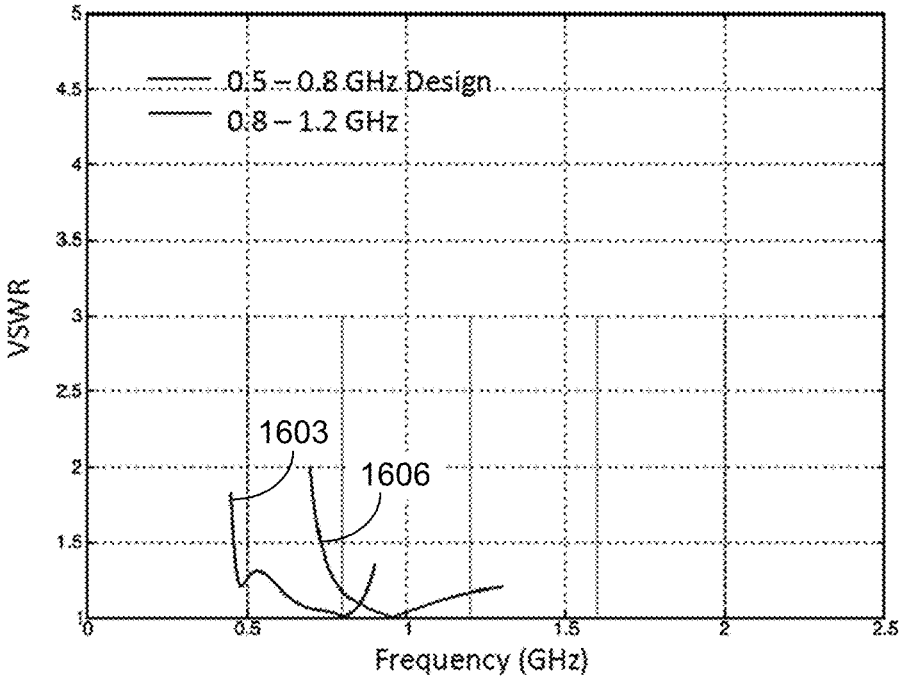

FIG. 15 shows the broadside realized gain of the antenna designs, while FIG. 16 shows the return loss of the antennas. Curve 1503 shows the 0.5-0.8 GHz design and curve 1506 shows the 0.8-12 GHz design. The gains are compared with an aperture gain limit (curve 1515). In FIG. 16, curve 1603 shows the 0.5-0.8 GHz design and curve 1606 shows the 0.8-12 GHz design.

Third Approach. The third approach illustrated in FIG. 8 is also useful for designing antennas. However, for the design of vertically or Horizontal polarized elements with a broadside beam, the lack of left/right and top/down symmetry in the third approach is a drawback. For cases where the desired beam direction is not broadside or the desired polarization is different, then the pixelated aperture should not have symmetry and the third approach is comparable to the second or first approaches.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A fragmented aperture antenna, comprising:

a two-dimensional (2D) lattice comprising non-overlapping rows of conducting elements and non-conducting regions having a common shape and size, the conducting elements and non-conducting regions having a width that is a width of the non-overlapping rows, where the conducting elements and non-conducting regions positioned in adjacent rows of the 2D lattice are offset based upon a fixed skew angle, the offset between adjacent rows being less than a length of the conducting elements and non-conducting regions; and diagonally adjacent conducting elements in the adjacent rows have adjacent parallel edges that overlap each other and non-parallel edges that extend from the adjacent parallel edges, where the adjacent parallel edges of the diagonally adjacent conducting elements overlap each other along a portion of the adjacent parallel edges of the diagonally adjacent conducting elements without overlapping the non-parallel edges of the diagonally adjacent conducting elements.

2. The fragmented aperture antenna of claim 1, wherein the conducting elements are rectangular conducting elements.

3. The fragmented aperture antenna of claim 2, wherein sides of the rectangular conducting elements define a pair of edge vectors and the fixed skew angle is defined by a pair of lattice vectors with at least one of the pair of lattice vectors not in parallel with either edge vector of the pair of edge vectors.

4. The fragmented aperture antenna of claim 1, wherein the length of the conducting elements is greater than the width, and the fixed skew angle is in a range from 75 degrees to 45 degrees.

5. The fragmented aperture antenna of claim 1, wherein at least one row of the 2D lattice comprises a series of at least two adjacent non-conducting regions adjacent to at least one of the conducting elements.

6. The fragmented aperture antenna of claim 1, wherein the common shape is not a rectangle.

7. The fragmented aperture antenna of claim 2, wherein the conducting elements are not square.

8. The fragmented aperture antenna of claim 4, wherein the fixed skew angle is in a range from 70 degrees to 50 degrees.

9. The fragmented aperture antenna of claim 6, wherein the common shape is a skewed-Z shape.

10. The fragmented aperture antenna of claim 6, wherein the conducting elements and non-conducting regions interleave in a digitated fashion to tessellate a plane defined by the 2D lattice.

11. The fragmented aperture antenna of claim 1, wherein at least one row of the 2D lattice comprises a series of at least two adjacent conducting elements.

12. The fragmented aperture antenna of claim 11, wherein the series of at least two adjacent conducting elements is adjacent to at least one of the non-conducting regions.

13. The fragmented aperture antenna of claim 1, wherein the 2D lattice comprises a plurality of connected fragments comprising a plurality of connected conducting elements having adjacent edges that overlap with the diagonally adjacent conducting elements of that connected fragment, wherein the plurality of connected fragments are individually separated by contiguous non-conducting regions.

14. The fragmented aperture antenna of claim 13, wherein the connected conducting elements are formed in a pattern determined using computational electromagnetic simulation to achieve a specified antenna performance including gain, bandwidth, polarization, pattern, or combinations thereof.

15. A fragmented aperture antenna, comprising:

a two-dimensional lattice of conducting elements having a single common shape that is not a rectangle, where the conducting elements interleave in a digitated fashion to tessellate a plane defined by the two-dimensional lattice; and diagonally adjacent conducting elements in the two-dimensional lattice comprising adjacent parallel edges and non-parallel edges that extend from the adjacent parallel edges, where the diagonally adjacent conducting elements overlap along a portion of the adjacent parallel edges of the diagonally adjacent conducting elements without overlapping the non-parallel edges of the diagonally adjacent conducting elements.

16. The fragmented aperture antenna of claim 15, wherein the single common shape is a skewed-Z shape.

17. The fragmented aperture antenna of claim 15, wherein the two-dimensional lattice comprises non-conducting regions between portions of the conducting elements, a shape of the non-conducting regions corresponding to a shape of one or more of the conducting elements.

18. The fragmented aperture antenna of claim 17, wherein the combination of the conducting elements and the non-conducting regions cover an aperture area of the plane defined by the two-dimensional lattice.

19. The fragmented aperture antenna of claim 18, wherein the distribution of the conducting elements and the non-conducting regions is based upon an adjacency matrix that increases coverage of the conducting elements in large non-conducting regions of the two-dimensional lattice or increases a size of a non-conducting region in large conducting regions of the two-dimensional lattice.

* * * * *